United States Patent [19]

Spivak

[11] 4,409,158

[45] Oct. 11, 1983

[54] SPRAY DRYING METHOD OF PREPARING HOLLOW FIBERS

[75] Inventor: Bruce D. Spivak, Norristown, Pa.

[73] Assignee: PQ Corporation, Valley Forge, Pa.

[21] Appl. No.: 365,061

[22] Filed: Apr. 2, 1982

Related U.S. Application Data

[62] Division of Ser. No. 227,130, Jan. 22, 1981, Pat. No. 4,361,624.

[51] Int. Cl.[3] ..... B29C 6/00;

[52] U.S. Cl. ..... 264/8; 264/13; 264/42; 264/63; 264/DIG. 19

[58] Field of Search ..... 264/8, 13, 63, 41–43; 428/398, 403

[56] References Cited

U.S. PATENT DOCUMENTS

| | | | |
|---|---|---|---|
| 3,400,189 | 9/1968 | Nacke | 264/8 |
| 3,652,749 | 3/1972 | Sobel et al. | 264/164 |
| 3,692,507 | 9/1972 | Gladney et al. | 65/2 |
| 3,888,957 | 6/1975 | Netting | 264/13 |
| 3,975,194 | 8/1976 | Farnand et al. | 264/13 |
| 4,039,718 | 8/1977 | Kallenborn | 428/398 |
| 4,222,977 | 9/1980 | Dobo | 264/63 |
| 4,277,269 | 7/1981 | Sweeting | 264/8 |
| 4,303,432 | 12/1981 | Torobin | 264/167 |
| 4,320,074 | 3/1982 | Birchall et al. | 264/164 |
| 4,348,341 | 9/1982 | Furuya et al. | 264/8 |

*Primary Examiner*—Jay H. Woo

*Attorney, Agent, or Firm*—Ernest G. Posner; Fred C. Philpitt

[57] ABSTRACT

Hollow fibers are prepared by spray drying a solution of a film-former in a volatile solvent. The viscosity of the solution must be 1.5 to 10 times the viscosity that usually results in spheres or microspheres. The preferred film-forming substance is a combination of sodium silicate and a "polysalt."

3 Claims, No Drawings

SPRAY DRYING METHOD OF PREPARING HOLLOW FIBERS

This application is a division of application Ser. No. 227,130, filed Jan. 22, 1981, now U.S. Pat. No. 4,361,624, issued Nov. 30, 1982.

BACKGROUND OF THE INVENTION

This invention relates to hollow fibers which can be employed as reinforcing and density altering additives for polymer systems. In particular, the invention involves hollow fibers formed by spray drying solutions of film-forming materials.

The use of various fibers, especially glass fibers, for reinforcing various polymer systems is very well known. Examples of an apparatus and method for preparing such fibers are found in U.S. Pat. No. 3,265,483. While such solid fibers are suitable for reinforcing various polymer systems, they are not effective in altering the density of such materials because of their own relatively high density. Numerous other materials are used as fillers for polymers and to control the density. Among these materials are hollow microspheres such as those described in U.S. Pat. No. 2,797,201, among many others. These materials provide no reinforcing effect.

The problem of reinforcing and altering the density of polymer systems has been recognized by others. U.S. Pat. No. 4,039,718 describes hollow glass filaments sealed at both ends. These materials are difficult and expensive to prepare, involving a separate sealing step after forming the open hollow fiber. U.S. Pat. No. 3,692,507 describes silicate fibers that are formed from attenuating flows of molten silicate glass, hydrating the fibers so produced and foaming the fiber by applying heat. These methods involve costly and relatively complex processing steps, and the materials have not been adapted for fabricating reinforced plastics.

It is an object of this invention to provide a hollow reinforcing fiber by a simplified production method.

SUMMARY OF THE INVENTION

I have found that hollow fibers useful in reinforcing polymers can be prepared by spray drying solutions of numerous film-forming substances. Many of these film-forming substances have also been used to produce hollow or solid spheres by spray-drying, but surprisingly small process changes produce hollow fibers instead of the hollow spheres. Increased viscosity of the feed to the spray-dryer favors the formation of fibers, as does an increased feed rate. The spray-dryer temperatures do not appear to affect product particle shape. I prefer inorganic silicate based materials as the film-forming substance. I most prefer a combination of sodium silicate and a "polysalt" such as a polyborate or polyphosphate.

THE INVENTION

Nearly any film-forming substance that can be dissolved in a volatile solvent can be used as a feed for the process of my invention to provide hollow fibers. Some examples of synthetic film-forming systems that may be used include polyvinyl alcohol, phenol-formaldehyde resin, urea-formaldehyde resin, melamine-formaldehyde resin, alkyd resin, polysiloxanes, cellulose esters, polyvinyl chloride, polyvinylchloride-polyvinylalcohol copolymes, polyvinyl butyrol, polystyrene, polyvinylidine chloride, polymethyl methacrylate, and polyamide resins. So-called "natural" film-forming systems are also useful and include soybean protein, zein protein alginates, cellulose xanthate and cuprammonium cellulose. Inorganic film-formers are useful as well, and include silicates, borates, and polyphosphates.

Some of these film-forming substances require the inclusion of a so-called "blowing agent" to form and expand the hollow fibers while they are still plastic and to prevent breakage under atmospheric pressure when the walls have set. Examples of useful blowing agents include inorganic or organic salts of carbonates, nitrates, carbamates, oxalates, formates, benzoates, sulfites, and bicarbonates. Strictly organic substances are also of value, such as p-hydroxy phenylazide, di-N-nitropiperazines, polymethylene nitrosamine, urea and many others. Selection of a particular blowing agent is based upon compatibility with the film-forming system and the intended use of the product.

Film-forming systems that are of particular value in carrying out the process of this invention and which do not require the addition of a so-called blowing agent are disclosed in U.S. Pat. No. 3,796,777 which is hereby incorporated by reference. The film-forming system comprises a sodium silicate and a "polysalt" such as polyborate or polyphosphates. Other descriptive information of my preferred film-forming system is disclosed in U.S. Pat. Nos. 3,794,503 and 3,888,957. These patents are hereby incorporated by reference. U.S. Pat. No. 3,794,503 describes the system most fully and, in Column 3, specifies the requirements of the "polysalt" needed to prepare hollow bodies, in this case hollow fibers. For this system "polysalts" are considered to be those salts with anion to cation ratios that are reduced when the salt is dissolved and becomes hydrolyzed. Ammonium pentaborate, sodium pentaborate and sodium hexametaphosphate are preferred polysalts. The composition of the preferred film-forming system can be 0.03 to 2.0 parts by weight (pbw) of "polysalt" solids per each pbw of silicate solids.

Any conventional spray drying equipment can be used to implement the process of this invention. The feed material can be atomized into the spray tower with either an atomizer wheel or a spray nozzle. Since a wide range of film-forming materials and solvents can be used in my process, a wide range of temperatures is employed to provide removal of solvent, and formation and expansion of the fibers in the spray tower. Inlet temperatures of 50° to 500° C. and outlet temperatures of 40° to 350° C. may be used successfully depending on the film-former and solvent employed. More particularly, inlet temperatures of 175° to 500° C. and outlet temperature of 100° to 300° C. are suitable when using the preferred film-forming system of sodium silicate and a "polysalt."

The viscosity of the solution containing the film-forming substance which is the feed to the spray dryer appears to be the most important variable influencing the preparation of hollow fibers. The feed solution must have a sufficiently high viscosity to maintain relatively continuous structures when the solution is sprayed or subjected to centrifugal force as is done in the usual atomization step of spray drying. The viscosity is considered sufficient if these fibers have a length that is at least 5 times the diameter. If the viscosity is low, drops are formed during atomization and spheres or hollow spheres are produced. It appears that good yields of hollow fibers are produced with solutions that have viscosities of 1.2 to 10 times the upper limit of the viscosity range that results in hollow spheres. For example, when using my preferred sodium silicate polysalt system, hollow microspheres are produced from solutions of up to about 150 cp, while feed solutions of 300 cp or more provide good yields of hollow fibers with aspect ratios of 8 or more.

The feed rate of the film-forming solution to the dryer also has some influence on the formation of hollow fibers rather than spheres. This relationship is difficult to quantify, but it appears that higher feed rates lead to a higher yield of fibers with a somewhat larger aspect ratio.

The product removed from the spray dryer comprises irregular convoluted fibers with large hollow regions separated by solid walls of varying thickness. The length of said fibers can vary widely, with aspect ratios of 8 or more. I prefer the fibers to be more than 100 microns in length and to have aspect ratios more than about 12 and up to about 65. These fibers have 8 to 20% loss on ignition (LOI) and a true particle density of 0.7 to 1.1 g/ml. These fibers can be best treated to further reduce the LOI and slightly expand the fibers so that the density is somewhat reduced. The heat treatment must be carried out carefully so that the walls of the fibers do not rupture. One successful heat treatment comprises heating the fibers to 100° C. and holding for an hour, then raising the temperature to 200° C. and holding for an hour, then raising the temperature to 300° C. and holding for 3 hours, and then cooling slowly. Any equivalent treatment would be satisfactory. The fibers treated in this manner have a LOI of 2 to 5% and a true particle density of 0.6 to 0.85 g/ml.

These fibers are useful as lightweight reinforcing agents for polymers, lightweight insulation and components in synthetic foams or cores.

EXAMPLES

The following examples illustrate certain embodiments of my invention. They are not intended to establish the scope of the invention, said scope being set forth in the disclosure and the claims. All proportions are in parts by weight (pbw) and percent by weight (%) unless otherwise indicated.

EXAMPLES 1-4

A series of feed solutions for the spray dryer were prepared by combining sodium silicate and ammonium pentaborate (APB). N ® sodium silicate was used as the silicate raw material and contains 8.9% $Na_2O$ and 28.9% $SiO_2$. N is a registered trademark of the PQ Corporation.

The following table summarizes the compositions of the feed solutions prepared.

TABLE I

| Run # | 1 | 2 | 3 | 4 |
|---|---|---|---|---|
| N ® Silicate (pbw) | 81.3 | 82.9 | 84.6 | 84.0 |
| APB (pbw) | 2.3 | 2.3 | 2.4 | 2.4 |
| $H_2O$ (pbw) | 16.4 | 14.8 | 13.0 | 13.5 |
| Viscosity* (cP) | 125 | 176 | 460 | 552 |

*Brookfield RVT Viscometer, #2 spindle @ 20 RPM at 25 C.

These feed solutions were prepared by dissolving the ammonium pentaborate in the water and then dispersing the resulting solutions into the silicate solution.

The solutions were spray dried in a Bowan 7-foot diameter spray dryer with a centrifugal atomizer. The inlet temperature was controlled at about 200° to 220° C., while the outlet temperature was 145° to 155° C. The feed rate remained constant throughout the four runs.

The product of feed solution run #1 was hollow microspheres with a LOI of 13.2%. The product of run #2 was a mixture of hollow microspheres and hollow fibers with a LOI of 13.5%. The products of both runs #3 and #4 were predominantly hollow fibers; only an occasional hollow microsphere was produced. The product of run #3 had a LOI of 17.5%, and the true density of the fibers was 0.92 g/ml. The LOI for run #4 was 11.9% with a true density of 0.87 g/ml.

EXAMPLE 5

The hollow fibers produced as a result of run #4 were further heat treated. The heat treatment was carried out by heating the material to 100° for an hour, then raising the temperature to 200° C. for an hour and then raising the temperature to 300° C. and holding for 3 hours. These hollow fibers had a LOI of 2.7% and a true density of 0.80 g/ml and were between about 100 microns to 1.25 cm in length, with an aspect rate range of 8 to 26.

I claim:

1. The process for preparing hollow fibers of more than about 100 microns in length by spray drying, comprising the steps of:
   a. Preparing an aqueous solution of sodium silicate and a "polysalt," said solution having a viscosity of 300 cp or more;
   b. Subjecting said solution to spray or centrifugal force, thereby forming fibers that are at least 5 times longer than their diameter, in a spray dryer.
   c. Maintaining the spray dryer at an inlet temperature of 175° to 500° C. and an outlet temperature of 100° to 300° C.; and
   d. Recovering the desired product.

2. The process of claim 1 wherein the "polysalt" is a polyborate or a polyphosphate.

3. The process of claim 2 wherein the polysalt is ammonium pentaborate, sodium pentaborate or sodium hexametaphosphate and the composition of the solution is such that there are 0.03 to 2.0 parts by weight of polysalt per part by weight of silicate solids.

* * * * *